US006418947B1

(12) United States Patent
MacNeil et al.

(10) Patent No.: US 6,418,947 B1
(45) Date of Patent: Jul. 16, 2002

(54) SCARIFIER FOR INTERIOR SURFACE OF PIPELINE

(75) Inventors: Gerard MacNeil, Surrey; David MacNeil, Langley; Gordon MacNeil, Delta; Vernon Bose, Langley, all of (CA)

(73) Assignee: Mac & Mac Hydrodemolition, Inc. (CA)

( * ) Notice: Subject to any disclaimer, the term of this patent is extended or adjusted under 35 U.S.C. 154(b) by 0 days.

(21) Appl. No.: 09/569,880

(22) Filed: May 12, 2000

Related U.S. Application Data

(62) Division of application No. 09/126,113, filed on Jul. 30, 1998, now Pat. No. 6,206,016.

(51) Int. Cl.[7] ..... B08B 3/02

(52) U.S. Cl. ..... 134/167 C; 134/166 C; 134/198; 239/743

(58) Field of Search ..... 134/166 C, 169 C, 134/168 C, 167 C, 201, 198; 15/302, 301, 321, 104.31, 340.1; 239/243, 165, 160, 722

(56) References Cited

U.S. PATENT DOCUMENTS

| | | | |
|---|---|---|---|
| 2,017,042 A | | 10/1935 | Dougherty |
| 2,089,597 A | * | 8/1937 | Carter |

(List continued on next page.)

FOREIGN PATENT DOCUMENTS

| | | | |
|---|---|---|---|
| DE | 2242062 | * | 2/1974 |
| EP | 0365921 | | 5/1990 |
| FR | 2499880 | | 8/1982 |
| GB | 2252807 | | 8/1992 |
| JP | 3-89986 | | 9/1989 |
| JP | 3-89987 | | 9/1989 |
| JP | 6-7754 | | 1/1994 |
| SU | 597441 | | 2/1978 |
| SU | 379295 | | 7/1978 |
| SU | 749458 | | 7/1980 |
| WO | WO 98/07532 | | 2/1998 |

OTHER PUBLICATIONS

PCT International Search Report International Application No. PCT/CA99/00690.

*Primary Examiner*—Frankie L. Stinson
(74) *Attorney, Agent, or Firm*—Hall, Priddy, Myers & Vande Sande

(57) ABSTRACT

Apparatus for scarifying an interior surface of a pipe both of round and non-round cross section. The apparatus, which has a nozzle for discharging fluid under pressure against the interior surface of the pipe, also has a vehicle moveable along an interior of the pipe in a direction substantially parallel to an axis of the pipe, a principal arm coupled to the vehicle and a scarifying assembly rotatably coupled to the principal arm having a fluid nozzle assembly with at least one fluid nozzle. The fluid nozzle assembly is operative to one of rotate and oscillate, one of the scarifying assembly and the principal arm being extendible to place the fluid nozzle at a location adjacent the interior surface of the pipe and operative, as the vehicle moves along the interior of said pipe, to remove contaminants and corrosion along a selected region along the interior surface of pipe. The selected region is of an area larger than an area that would be scarified by the nozzle if it were not rotating or oscillating, when the fluid from the fluid nozzle assembly is directed as a jet against the interior surface of the pipe.

18 Claims, 8 Drawing Sheets

U.S. PATENT DOCUMENTS

| | | | | |
|---|---|---|---|---|
| 2,090,851 | A | * | 8/1937 | Perkins |
| 2,461,517 | A | | 2/1949 | Carnevale |
| 3,016,201 | A | | 1/1962 | Brogden |
| 3,074,649 | A | * | 1/1963 | Atkinson |
| 3,099,852 | A | * | 8/1963 | Grant |
| 3,109,262 | A | * | 11/1963 | Weaver et al. |
| 3,153,510 | A | | 10/1964 | Brannfors et al. |
| 3,230,668 | A | * | 1/1966 | Stanley |
| 3,833,175 | A | | 9/1974 | Pulk |
| 4,073,302 | A | | 2/1978 | Jones |
| 4,161,956 | A | | 7/1979 | Hadgkiss |
| 4,314,427 | A | * | 2/1982 | Stoltz |
| 4,603,661 | A | | 8/1986 | Nelson et al. |
| 4,690,159 | A | | 9/1987 | Vadakin et al. |
| 5,004,156 | A | | 4/1991 | Montanier |
| 5,018,545 | A | | 5/1991 | Wells |
| 5,020,188 | A | | 6/1991 | Walton |
| 5,046,289 | A | * | 9/1991 | Bengel et al. |
| 5,052,423 | A | | 10/1991 | Chapman et al. |
| 5,072,487 | A | | 12/1991 | Walton |
| 5,081,800 | A | | 1/1992 | Ruholl |
| 5,113,885 | A | | 5/1992 | Ramsey |
| 5,203,646 | A | | 4/1993 | Landsberger et al. |
| 5,317,782 | A | | 6/1994 | Matsuura et al. |
| 5,322,080 | A | | 6/1994 | Rankin |
| 5,352,298 | A | | 10/1994 | Moulder |
| 5,518,553 | A | | 5/1996 | Moulder |
| 5,520,734 | A | | 5/1996 | Taylor et al. |
| 5,522,677 | A | | 6/1996 | Schlecht |
| 5,561,883 | A | | 10/1996 | Landry et al. |
| 5,851,580 | A | | 12/1998 | Amberg et al. |

* cited by examiner

SCARIFIER FOR INTERIOR SURFACE OF PIPELINE

RELATED APPLICATION

This application is a division of U.S. patent application Ser. No. 09/126,113 filed Jul. 30, 1998 now U.S. Pat. No. 6,206,016.

FIELD OF THE INVENTION

The present invention relates to a device for scarifying the interior surface of a pipe and more specifically for scarifying the interior surface of a sewer pipe by removing corrupted material from the interior surface of the sewer pipe.

BACKGROUND OF THE INVENTION

Pipes used to carry liquids and gases commonly transport all types of materials including water, natural gas, solid and liquid sewage, as well as various other accumulations from the pipe. Over time, these pipes require servicing and cleaning. Taylor et al. disclose automated systems for cleaning the outside of a pipeline in U.S. Pat. No. 5,520,734. Taylor et al. excavate under subterranean pipe and restore it by first cleaning the pipe and then applying a protective coating to the outer surface. As yet, however, nobody has automated a process for cleaning or restoring the inside of a pipe.

The interior surface of a pipeline carrying solids, liquids and gases generally degrades over time as the pipe walls interact chemically and physically with the substances flowing through them. In particular, a sewer system's interior walls corrode and deteriorate because corrosive materials contaminate the surface degrading the metal and concrete used to build the sewer. The corrosive material arises from both the sewage and waste water itself, and also from the digestive by-products of bacteria found in the sewage, which proliferate in the anaerobic environment. The corrosion causes the walls of the sewer pipe to physically decay, eventually reducing their overall thickness.

The principal source of corrosion is sulfuric acid, which arises as a product of the materials transported in a sewer pipe and the sewer environment itself. Various metal sulfates found in the sewage quickly convert into hydrogen sulfide by: reducing to sulfide ions in the waste water, combining with hydrogen in the water and outgassing above the liquid as hydrogen sulfide gas. Additional hydrogen sulfide originates from bacteria containing contaminants which accumulate on the relatively rough concrete below the maximum liquid level. Bacteria found in these accumulations thrive in the anaerobic sewer environment producing hydrogen sulfide gas as a respiratory bi-product. Oxygen from the liquid below and oxygen condensing from the water in the air react with the hydrogen sulfide on the pipeline walls creating the highly corrosive sulfuric acid. The sulfuric acid attacks the calcium hydroxide in the concrete sewer walls leaving calcium sulfates which ultimately crumble and fall off of the interior of the wall substantially reducing its thickness.

The waste water level varies over the course of a 24 hour period. The flow is at its lowest level between 1:00 AM and 6:00 AM in the morning but it rises distinctly in the daytime and the pipe may operate near capacity. Because of the gaseous nature of the hydrogen sulfide, the pipe walls are predominately corroded in the portions of the wall above the minimum liquid level. Portions of the walls which are always below the water level are not subjected to such high concentrations of hydrogen sulfide gas or sulfuric acid and consequently do not experience the same levels of decay.

Eventually the sewer walls must be restored or they can suffer permanent damage leading to great expense. The restoration process is a two step operation that consists of first cleaning all of the contaminants from the surface of the pipe (and removing and possibly repairing outer layers of corrupted concrete) and then applying a protective coating over the newly cleaned pipe surface. Attempting to apply a protective coating without first cleaning the pipe surface is futile because it does not stop the decay that has already began underneath the coating. Furthermore, the protective coating itself does not adhere well to the contaminated surface. Thus, cleaning is an essential element of the restoration process.

As previously mentioned, a sewer system typically operates at high capacity during the day with decreasing flow overnight. In order to restore the sewer pipes without diverting the flow (a costly and sometimes impossible alternative), a bulk of the work must be done at night during the brief period when the flow is at a minimum. As previously outlined, the restoration process involves both cleaning the pipe surface and applying a protective coat. In practice, the rate of restoration is impaired because manual cleaning takes a proportionally greater amount of time than does the application of the protective coat. Consequently, a need exists for an automated cleaning process. Such a process will improve the rate of cleaning of the pipeline's interior walls making restoration without diversion a cost-effective possibility. Further, automation of the process can help to ensure that the same intensity of cleaning is applied to the entire surface without the quality variation that is inherent in manual execution.

Several patents such as Taylor et al. (U.S. Pat. No. 5,520,734), describe automated processes for cleaning the outside surface of pipelines using spray nozzle jets, however, none have attempted to automate the cleaning of the interior surface of a pipeline.

SUMMARY OF THE INVENTION

According to the invention there is provided an apparatus for scarifying an interior surface of a pipe both of round and non-round cross section. The apparatus, which has a nozzle for discharging fluid under pressure against the interior surface of the pipe, also has a vehicle moveable along an interior of the pipe in a direction substantially parallel to an axis of the pipe, a principal arm coupled to the vehicle and a scarifying assembly rotatably coupled to the principal arm having a fluid nozzle assembly with at least one fluid nozzle. The fluid nozzle assembly is operative to one of rotate and oscillate, one of the scarifying assembly and the principal arm being longitudinally extendible to place the fluid nozzle at a location adjacent the interior surface of the pipe and operative, as the vehicle moves along the interior of said pipe, to remove contaminants and corrosion along a selected region along the interior surface of pipe. The selected region is of an area larger than an area that would be scarified by the nozzle if it were not rotating or oscillating, when the fluid from the fluid nozzle assembly is directed as a jet against the interior surface of the pipe.

The scarifying assembly may have an exchanger couplable to a source of pressurized fluid, and a plurality of nozzle branches coupled to the exchanger and a plurality of nozzles affixed to a distal end of each of the nozzle branches. The exchanger, nozzle branches and nozzles may be operative to rotate relative to the vehicle and the exchanger may be operative to direct pressurized fluid into each of the nozzle branches and out of each of the nozzles as a jet stream of fluid capable of scarifying on impact the interior surface of the pipe.

The fluid nozzle assembly may include a plurality of branches mounted to a distal end of the arm, with the branches being rotatable about an axis parallel to an axis of the principal arm, and plurality of fluid nozzles, with each fluid nozzle attaching to a corresponding one of the branches. Each of the fluid nozzles is operative to expel a jet of pressurized fluid against the interior surface of the pipe. The principal arm is longitudinally adjustable to position the fluid nozzles at a desired position adjacent to the interior surface of the pipe.

The nozzle assembly may scarify a linear swath along the interior surface of the pipe along the direction of travel of the vehicle.

One of the principal arm and the nozzle assembly may be longitudinally extendible to locate the nozzles adjacent to a bottom surface of the pipe so that the pressurized fluid expelled from the nozzles impacts the bottom surface of the pipe.

The vehicle may have a chassis operative to support the scarifying assembly with a pair of spaced apart tracks positioned on either side of the chassis. The tracks may be operative upon rotation to propel the vehicle along a longitudinal direction in the interior of the pipe and may be laterally adjustable to accommodate various pipe sizes. A motor may be mounted on the chassis, may be coupled to the spaced apart tracks, and may be operative to rotate the tracks. A power coupler may be mounted on the chassis and couplable to a power source. The power coupler may be operative to conduct power to the apparatus.

The principal arm may be telescoping and pivotally attached to the vehicle and pivotal through an angle proximate 0 degrees to the horizontal when the vehicle is on a level surface to an angle proximate 180 degrees and a nozzle assembly affixed to a distal end of the principal arm, the nozzle assembly being one of rotatable and oscillatory about a longitudinally extending axis of the principal arm.

The power coupler may be operative to provide power to an actuator, and the actuator operative to move the scarifying assembly with respect to the vehicle.

The exchanger may be operative to use energy from the pressurized fluid to move the cleaning assembly with respect to the vehicle.

The scarifying assembly may further include a plurality of telescoping subsidiary arms rotatably mounted to the principle arm and a nozzle assembly mounted to a distal end of each of the subsidiary arms, each nozzle assembly being one of rotatable and oscillatory about an axis parallel to a longitudinally extending axis of each subsidiary arm and operative to emit jets of pressurized fluid outwardly away from the distal end substantially parallel to the longitudinally extending axis.

The principal arm may be removable from the vehicle and the tracks laterally adjusted towards each other to allow the vehicle to pass through access openings to the pipe.

In another aspect of the invention there is provided a method of scarifying an interior surface of a pipe to remove contaminants and corrosion products, using a self-propelled vehicle carrying an attached principal arm with a nozzle assembly at a distal end thereof. The nozzle assembly has a plurality of nozzles mounted at a free end of associated nozzle branches, the nozzle branches being rotatable or capable of oscillation about a distal end of the principal arm. The method includes positioning the nozzle assembly so that the nozzles are at a desired position adjacent a first selected region of the interior surface of the pipe, activating the vehicle so that it moves down the pipe at a selected speed, rotating the nozzle branches and nozzles, and applying pressurized fluid to the nozzles so that they each emit a jet that scarifies a swath of the interior surface of the pipe along the direction of travel of the vehicle.

The method may include pivoting the principle arm so that the nozzles are adjacent to a second selected region and repeating the foregoing steps.

BRIEF DESCRIPTION OF THE DRAWINGS

Further features and advantages will be apparent from the following detailed description, given by way of example, of a preferred embodiment taken in conjunction with the accompanying drawings, wherein.

DESCRIPTION OF THE PREFERRED EMBODIMENT

Figure 1:
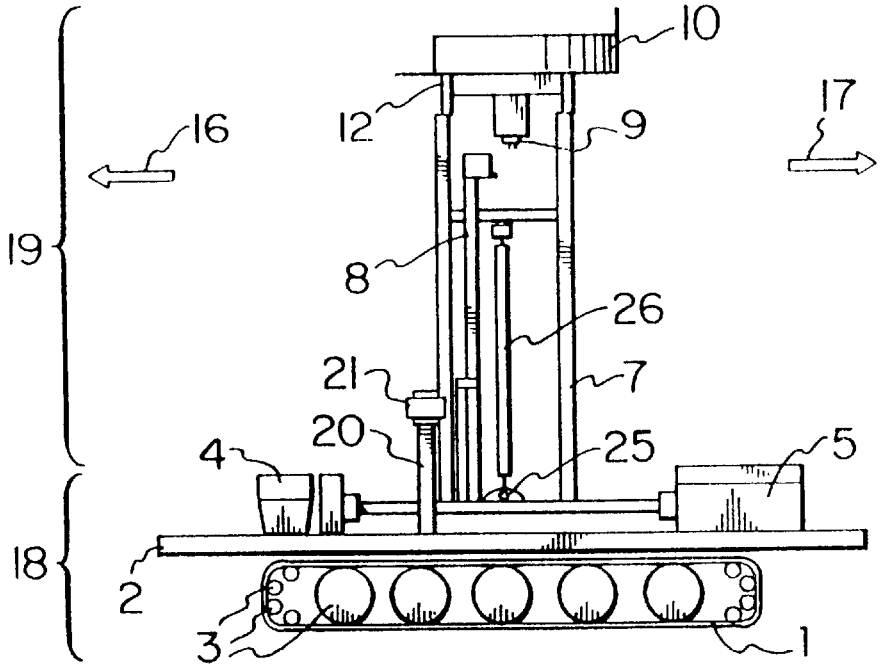
FIG. 1 is a side elevation view of the scarifier showing the vehicle and the scarifying assembly consisting of the arm and the nozzle assembly.
Figure 2:
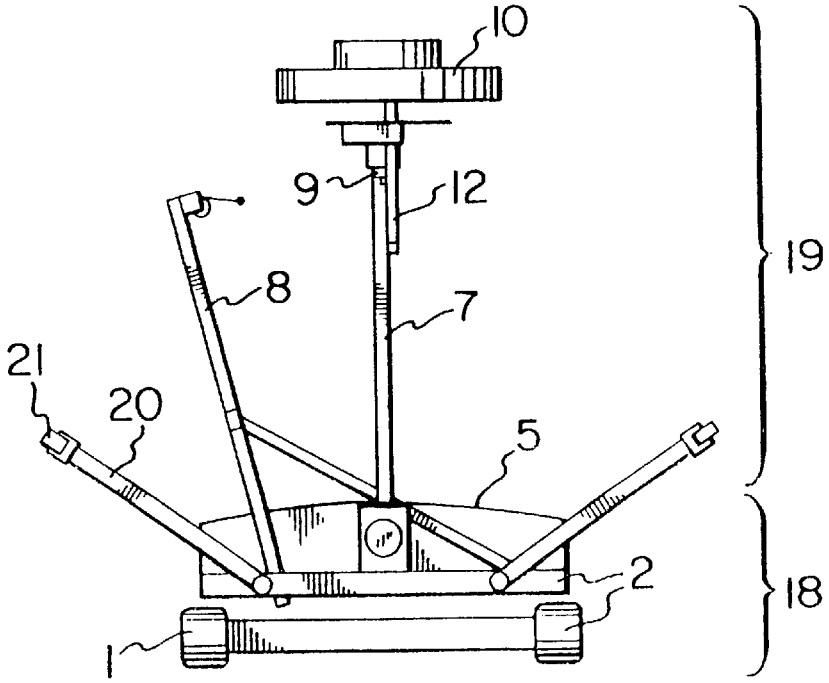
FIG. 2 is a front elevation view of the scarifier showing the arm in a vertical orientation.
Figure 3:
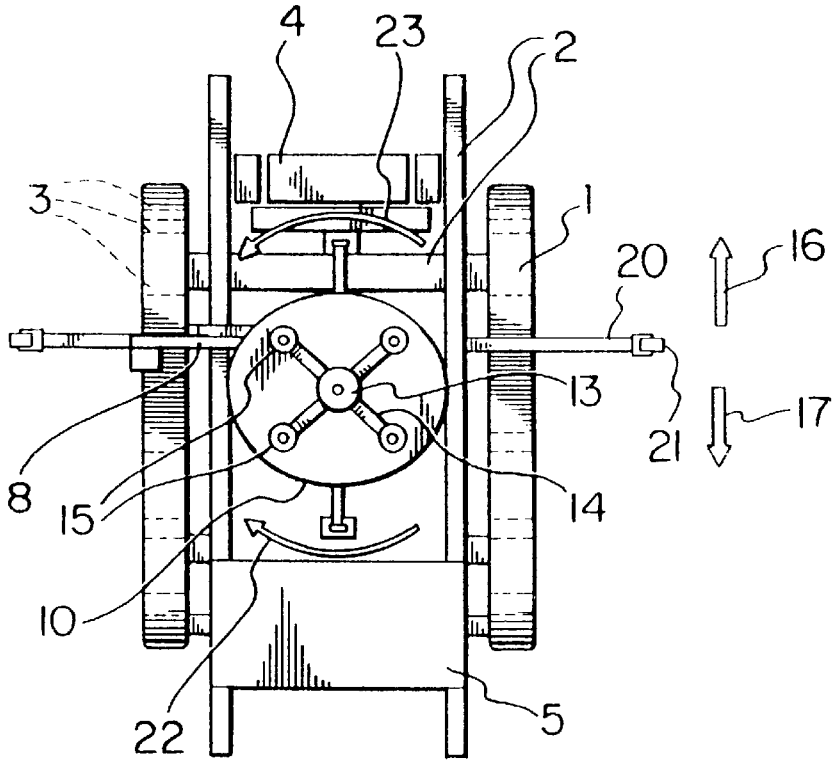
FIG. 3 is a top view of the scarifier showing the principal arm in a vertical orientation.
Figure 4:
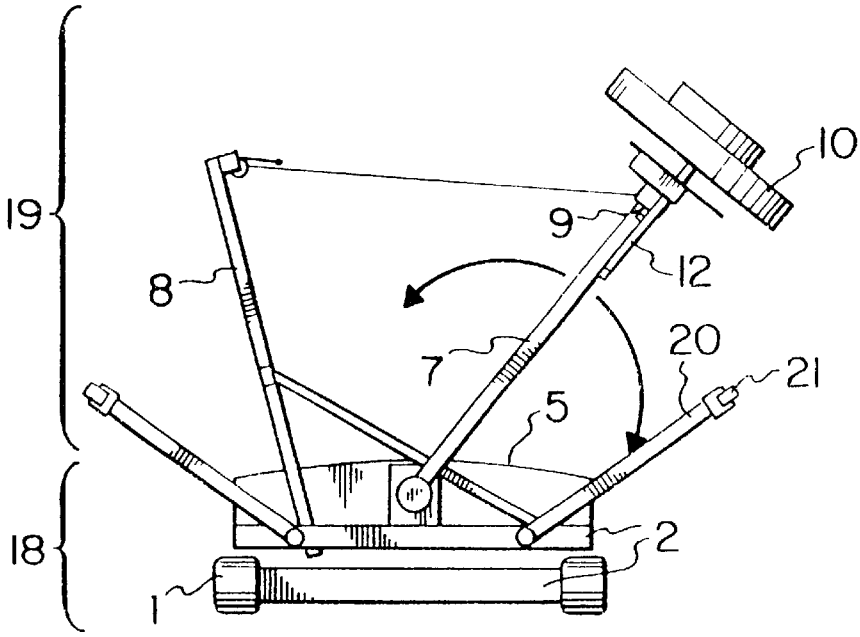
FIG. 4 is a front elevation view of the scarifier showing the arm extended at a radial angle to reach the interior surface of the pipe.
Figure 5:
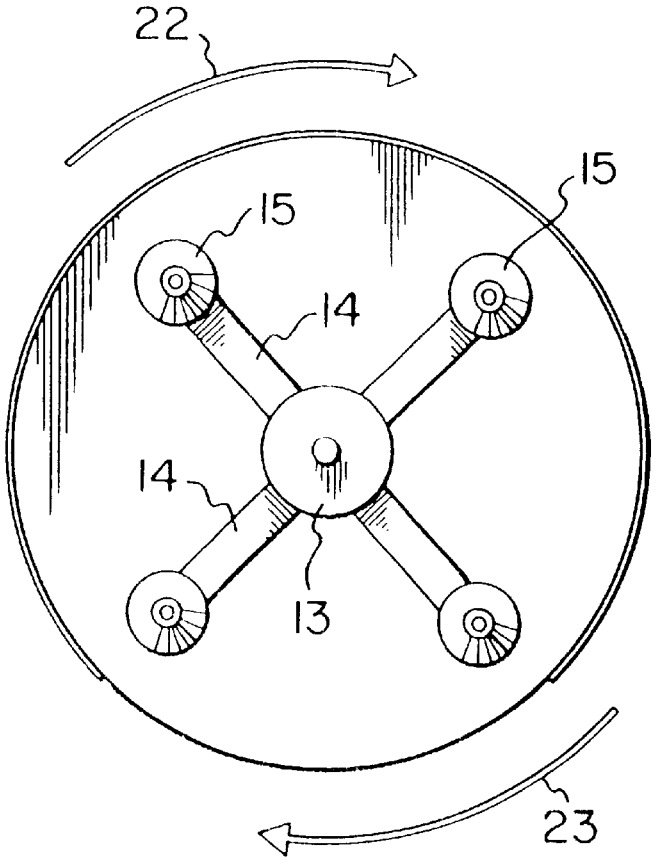
FIG. 5 is a top view of the nozzle assembly of the scarifier.
Figure 6:
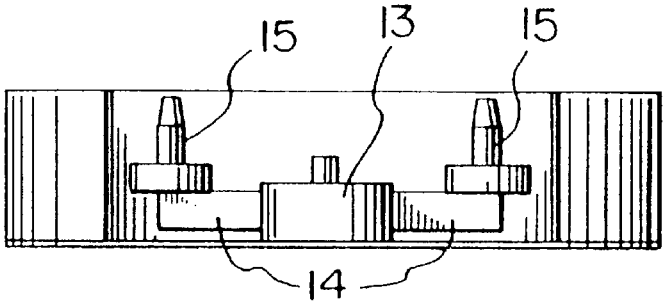
FIG. 6 is a side elevation view of the nozzle assembly used in the scarifier.

The scarifier for cleaning off corrosion products and contaminants from the interior surface of a pipeline is depicted in FIGS. 1–4. FIGS. 1–3 depict side, front and top views respectively of the scarifier with the arm 7 oriented in a vertical position. FIG. 4 depicts a front view of the apparatus with the arm 7 at a transverse angle. The nozzle assembly 10 of the scarifier is depicted in FIGS. 5 and 6.

The scarifier comprises a vehicle 18 that propels itself along a longitudinal direction inside of a pipe, cleaning off corroded material from the interior surface as it travels. The scarifier is equipped with a scarifying assembly 19 comprising an arm 7 and a nozzle assembly 10. The scarifying assembly 19 extends from the vehicle to the wall of the conduit and uses spray nozzles to clean the pipe surface.

The vehicle 18 includes a chassis 2, which moves longitudinally along the bottom floor of the pipe on its tracks 1. The tracks 1 are propelled along rollers 3 by a hydraulic motor (not shown) sitting on board the chassis 2. Although tracks 1 are included in this description of the preferred embodiment, any actuator capable of moving the vehicle 18 under power from the hydraulic motor will suffice. The hydraulic motor is powered by an external hydraulic reservoir (not shown) coupled to the apparatus by a hydraulic coupler (not shown) also mounted on the chassis 2. It will be noted that, although a hydraulic motor is used in this embodiment, that any power providing means, either external or on-board, but preferably exhaustless, may be used for this application. The direction of motion of the vehicle is that of arrow 16 or 17. An on-board battery 4 powers hydraulic switches (not shown), which control the speed and direction of motion of the vehicle. The motor, hydraulic coupler and hydraulic switches are covered with plate 5 to protect their sensitive parts from debris dislodged during cleaning. When nozzles 15 are employed to clean the walls of the conduit, recoil forces may tend to disturb the vehicle trajectory. Accordingly, a number of guiding bars 20 may be attached to the chassis 2 of the vehicle 18 and telescopically extend to the walls of the pipeline. The guiding bars' wall engaging attachments 21 move along the pipe's walls and prevent the vehicle 18 from deviating from its path.

The scarifying assembly 19 consists of a telescoping arm 7 and a nozzle assembly 10. The arm 7 includes two telescoping pipes in which the upper portion of the pipe 12 has a smaller diameter such that it slides down into the lower portion. The piston 26 controls the extension of the telescoping arm 7. This combination of telescoping parts permits the arm 7 to be extended or contracted longitudinally depending on the diameter of the pipe surface to be cleaned. The arm 7 pivots on hinge 25 in a lateral direction so that it can reach any transverse angle between 0° and 180°. Consequently, the device can manipulate the scarifying assembly 19 so that the nozzle assembly 10 is in close proximity to the pipe walls. Since this embodiment contains only one arm 7, a stabilizing bar 8 is used to counteract the weight of the arm 7 as it is extended radially.

The scarifying assembly 19 may be easily removed from the chassis 2 of the vehicle 18 and the width of the tracks narrowed in order to reduce the size of the apparatus so as to enter a sewer system through a small aperture such as a manhole.

The nozzle assembly 10 is mounted at the distal end of the arm's 7 telescoping pipes. Fluid coupler 9 with a flow control valve is attached to an external source of fluid under pressure (not shown), which is fed into exchanger/actuator 13. Referring to FIG. 5, exchanger/actuator 13 causes the nozzle assembly 10 to rotate or oscillate and distributes the fluid to each branch 14 of the nozzle assembly 10. The direction of rotation is indicated by arrows 22 and 23. The actual nozzles 15 are jets aimed into the pipeline walls. The nozzles 15 discharge fluid to scarify the interior surface of the pipe. The drawings show one nozzle 15 attached to each branch 14, but it should be obvious to one skilled in the art that a plurality of nozzles 15 may be coupled to each branch 14.

Figure 7:
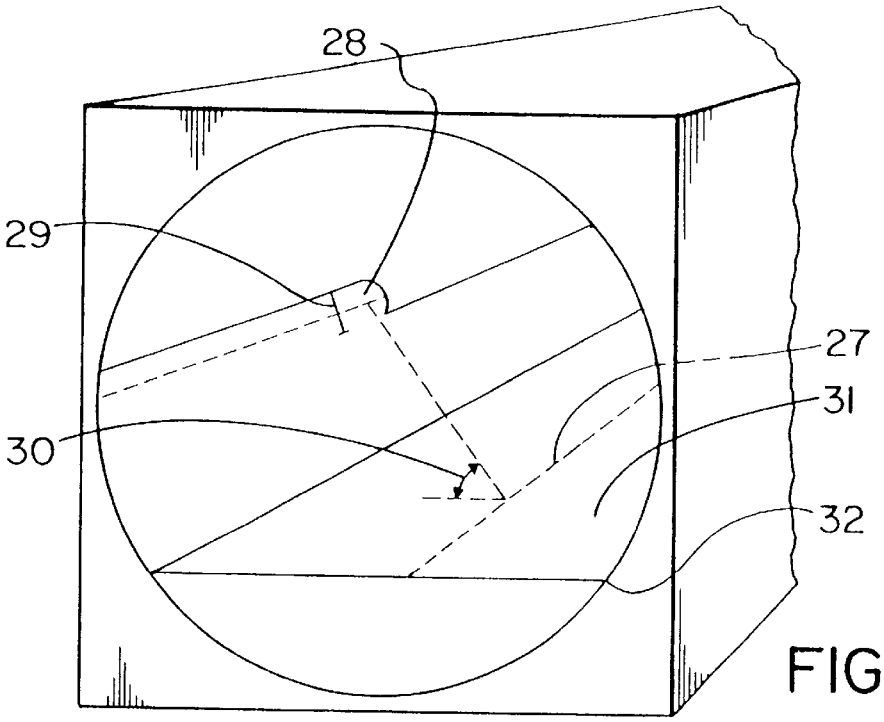
FIG. 7 is a perspective view showing the swath cleaned by the scarifier showing how several passes are required to clean the entire pipe.

Referring now to FIGS. 4 and 7, as the vehicle 18 travels up the center of the pipe floor 27, the scarifying assembly 19 scarifies a swath of the pipe wall 28. The swath is approximately the same width 29 as the diameter of the nozzle assembly 10 and is centered approximately at the arm angle 30. Fully cleaning the interior surface of the pipe requires that the vehicle 18 make several passes back and forth, changing the arm angle 30 with each pass. The vehicle chassis is outfitted with a drawbar (not shown) which holds the hydraulic and pressurized fluid tethers away from the apparatus so that it may easily travel forwards or reverse without running over the tethers.

An additional safety feature not shown in the drawings is a "deadman" which is a safety switch operative to cut off the high pressure from the moving parts of the scarifying assembly 19. The deadman is useful in both emergency situations and when minor adjustments must be made to the apparatus during a job.

This apparatus is the preferred embodiment when the conduits or pipes are not perfectly cylindrical in shape (i.e. they are some other shape such as semicircular in cross section). This embodiment can also be used for a cylindrical pipe when flow diversion is impossible. A false floor 31 is layered on top of the minimum flow mark 32 and the scarifying is performed above the false floor 31. Since most of the corrosion occurs in levels above the minimum liquid level 32, this scarifying method is acceptable for restoration applications.

Figure 8:
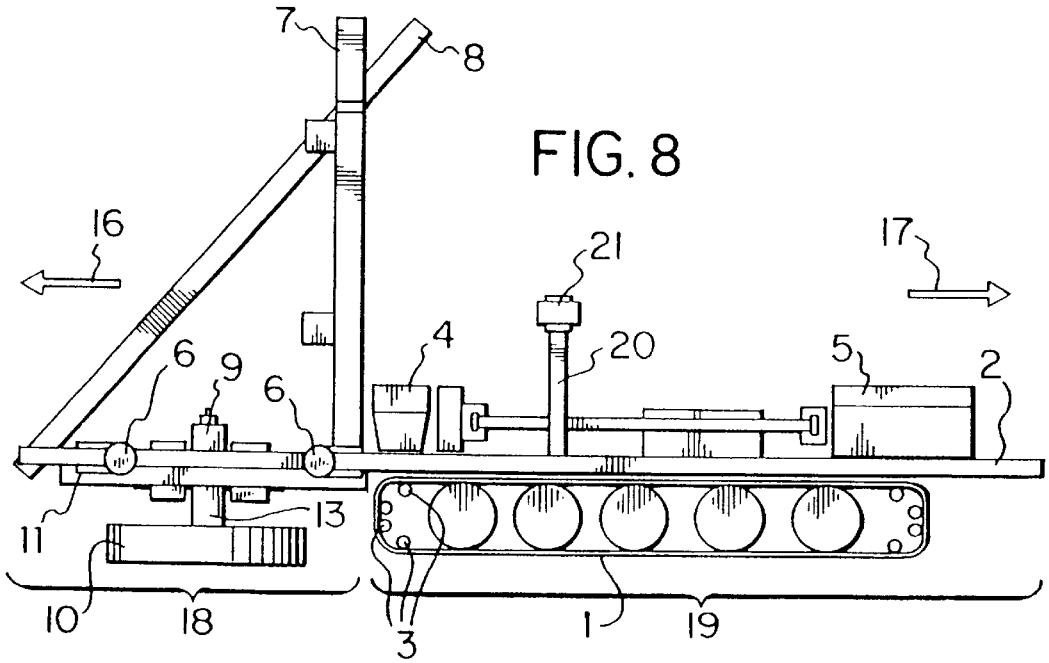
FIG. 8 shows a side elevation view of a first variant of the scarifier for cleaning the bottom surface of a pipe.
Figure 9:
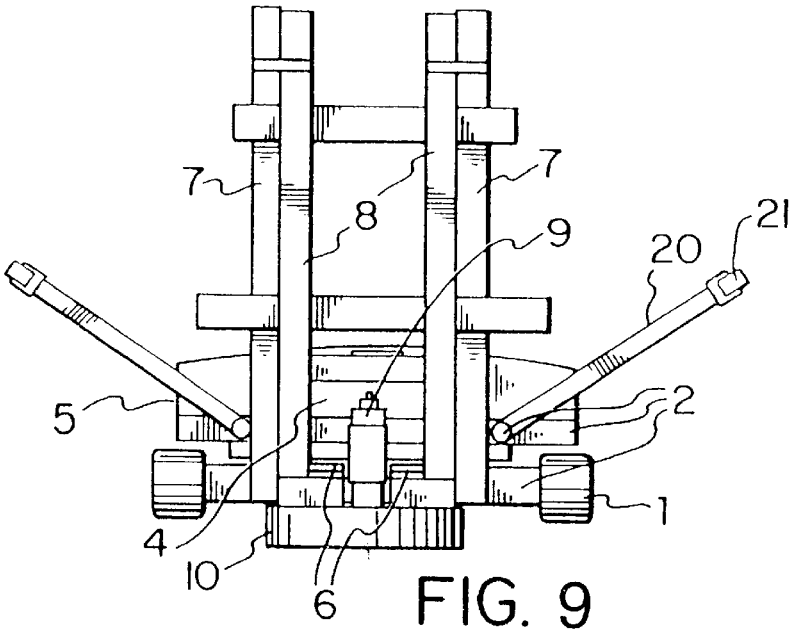
FIG. 9 shows a front elevation view of the first variant of FIG. 8.
Figure 10:
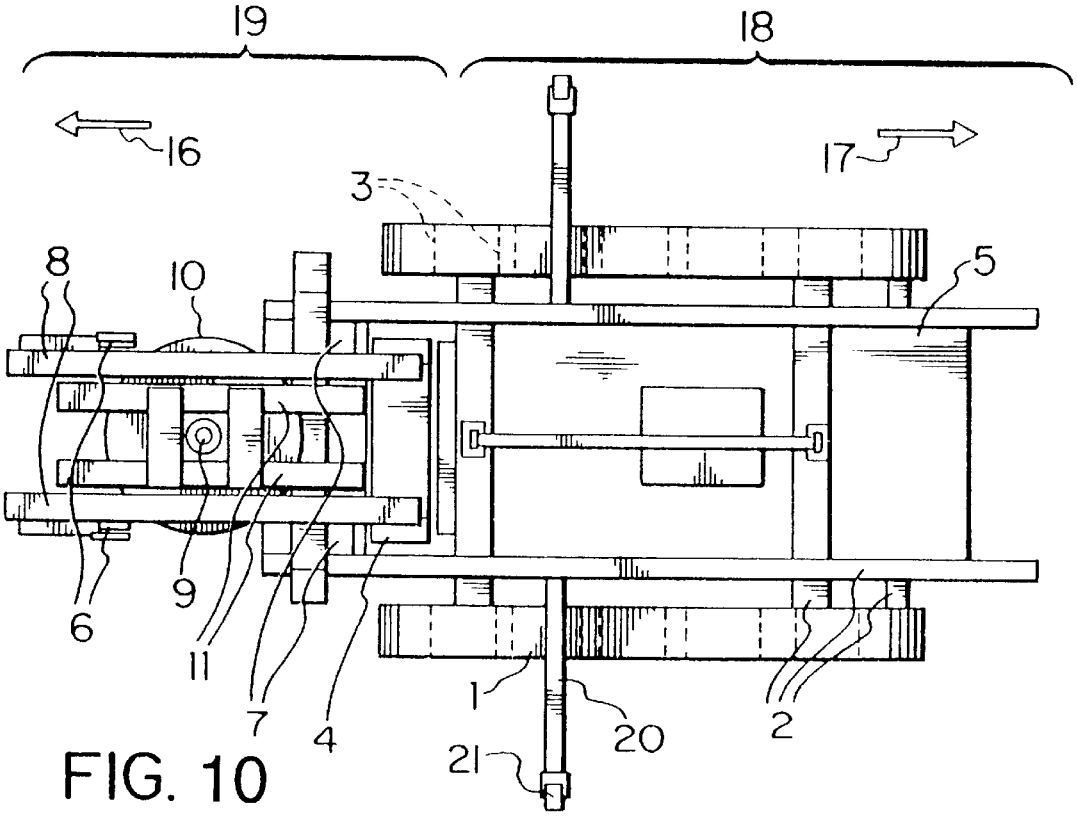
FIG. 10 depicts a top view of the first variant of FIG. 8.

A first variant of the scarifier, particularly adapted to clean the bottom surfaces of pipelines, is depicted in FIGS. 8–10. FIGS. 8–10 show the side, front and top views, respectively. The principal arm 7 is connected to the front of the chassis 2, but the nozzle assembly 10 is similar to that of the scarifier of FIGS. 1–4.

The vehicle 18, chassis 2, motor (not shown), guiding bars 20, guiding bar attachments 21, battery 4, hydraulic coupler, deadman and drawbar (not shown) are substantially the same as those of the scarifier of FIGS. 1–4. The scarifying assembly 19, however, is considerably different. The principal arm 7 is oriented vertically and has an additional subsidiary arm 11, which extends horizontally from the principal arm 7. The adjusters 6 move vertically up the principal arm 7 to adjust the height of the subsidiary arm 11. The subsidiary arm 11 holds the nozzle assembly 10, and the fluid coupler 9 with flow control valve which are basically the same elements as in the scarifier. The nozzle assembly 10 is outfitted with an exchanger actuator 13, symmetrical branches 14, and nozzles 15. Note: these elements are shown in FIGS. 5 and 6. A stabilizing bar 8 extends from the front end of the subsidiary arm 11 to the top end of the principal arm 7 to help stabilize the front of the apparatus when it is carrying the additional weight of the nozzle assembly 10.

The vehicle 18 travels longitudinally along the center of the pipe in a direction indicated by arrows 16 or 17, while the branches 14 of the nozzle assembly 10 rotate or oscillate, moving the nozzles 15 around on the bottom surface of the pipeline. The nozzles 15 cut a swath similar to the scarifier of FIG. 1 except that the swath is on the bottom surface of the pipe rather than at a radial angle. The first variant is specifically suited for scarifying the bottom surface of a pipeline.

Figure 11:
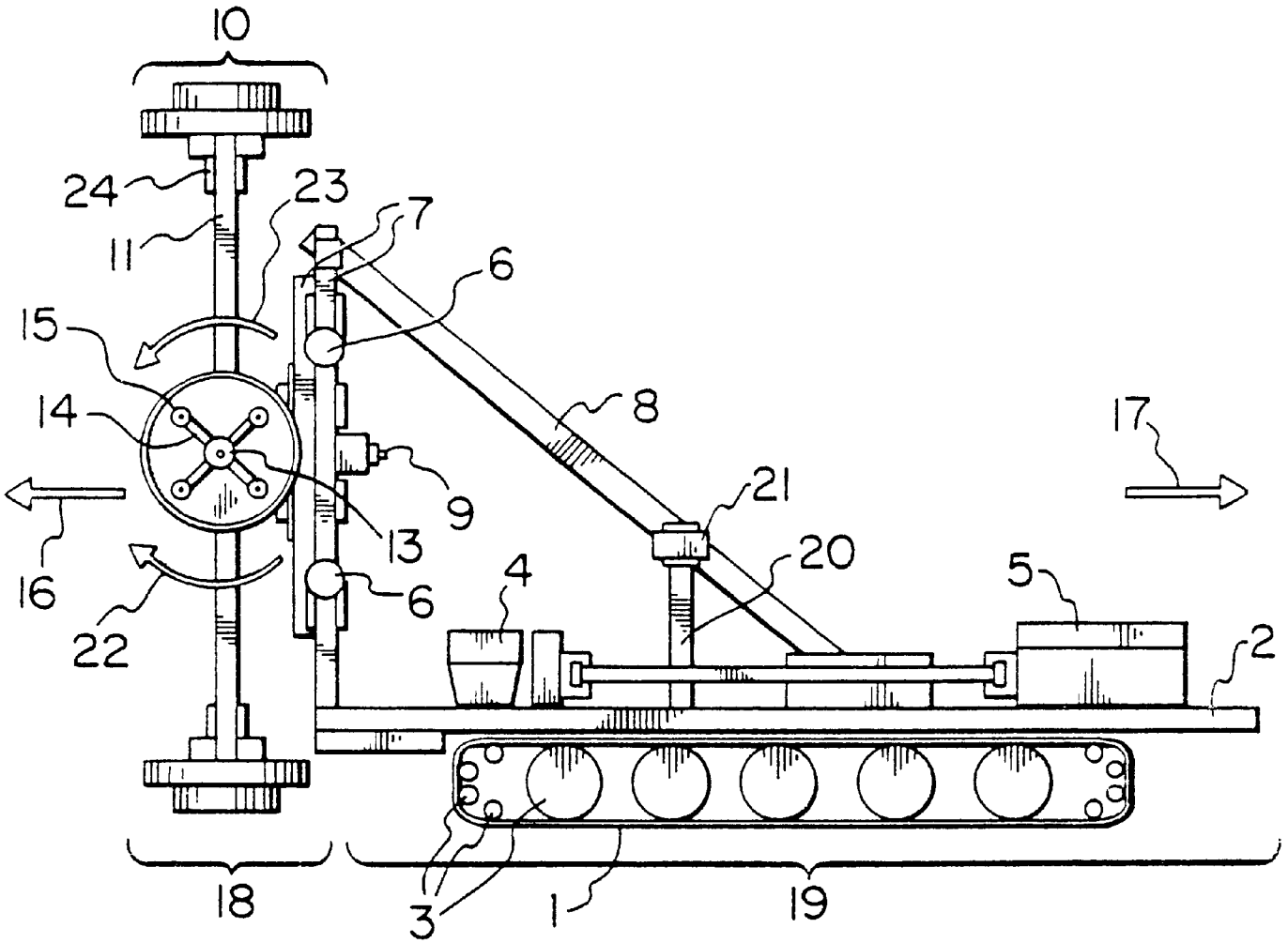
FIG. 11 is a side view of a second variant showing the principal arm and the subsidiary arms holding the nozzle assemblies.
Figure 12:
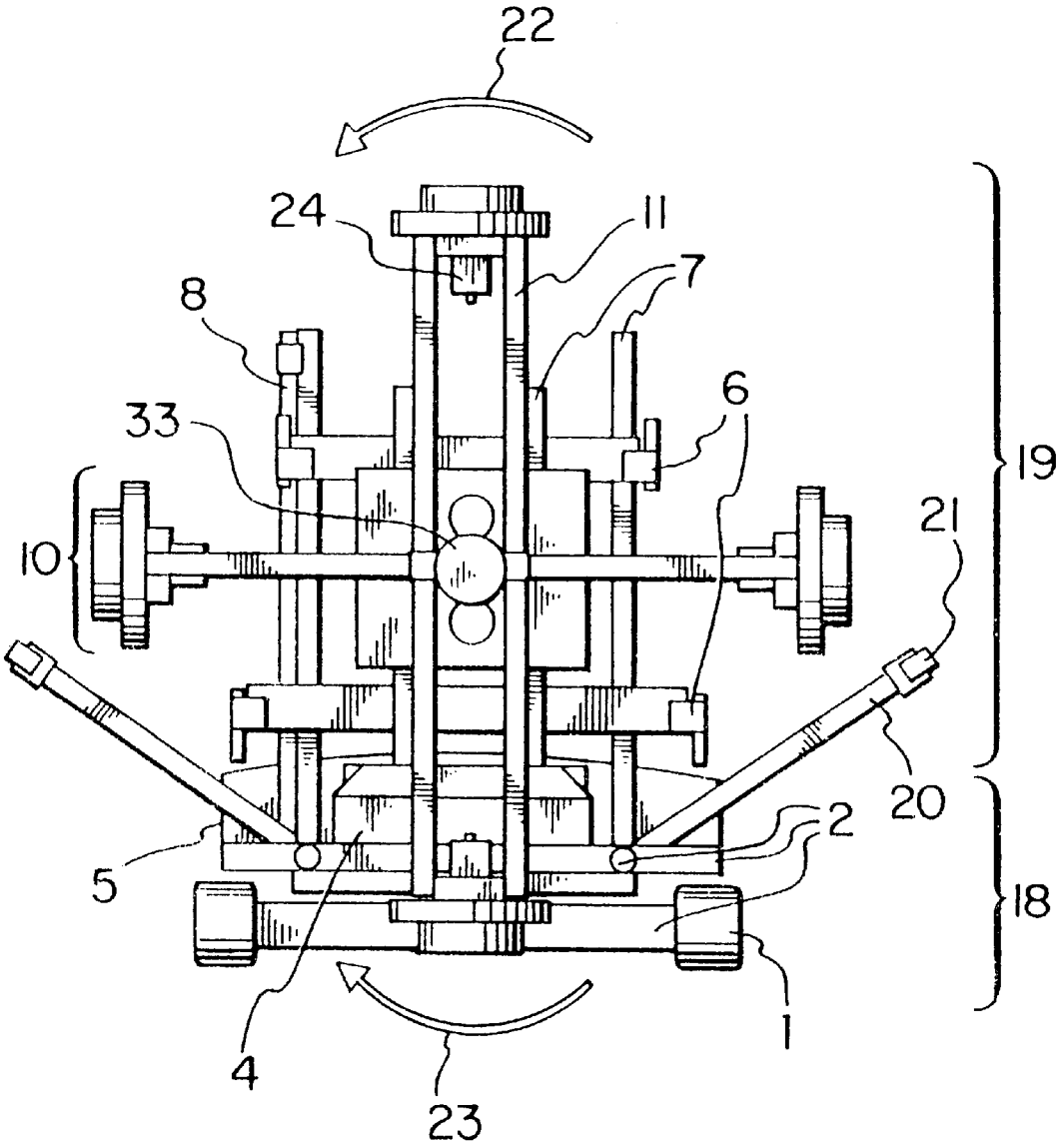
FIG. 12 is a front view of the second variant showing the principal arm and the subsidiary arms holding the nozzle assemblies.
Figure 13:
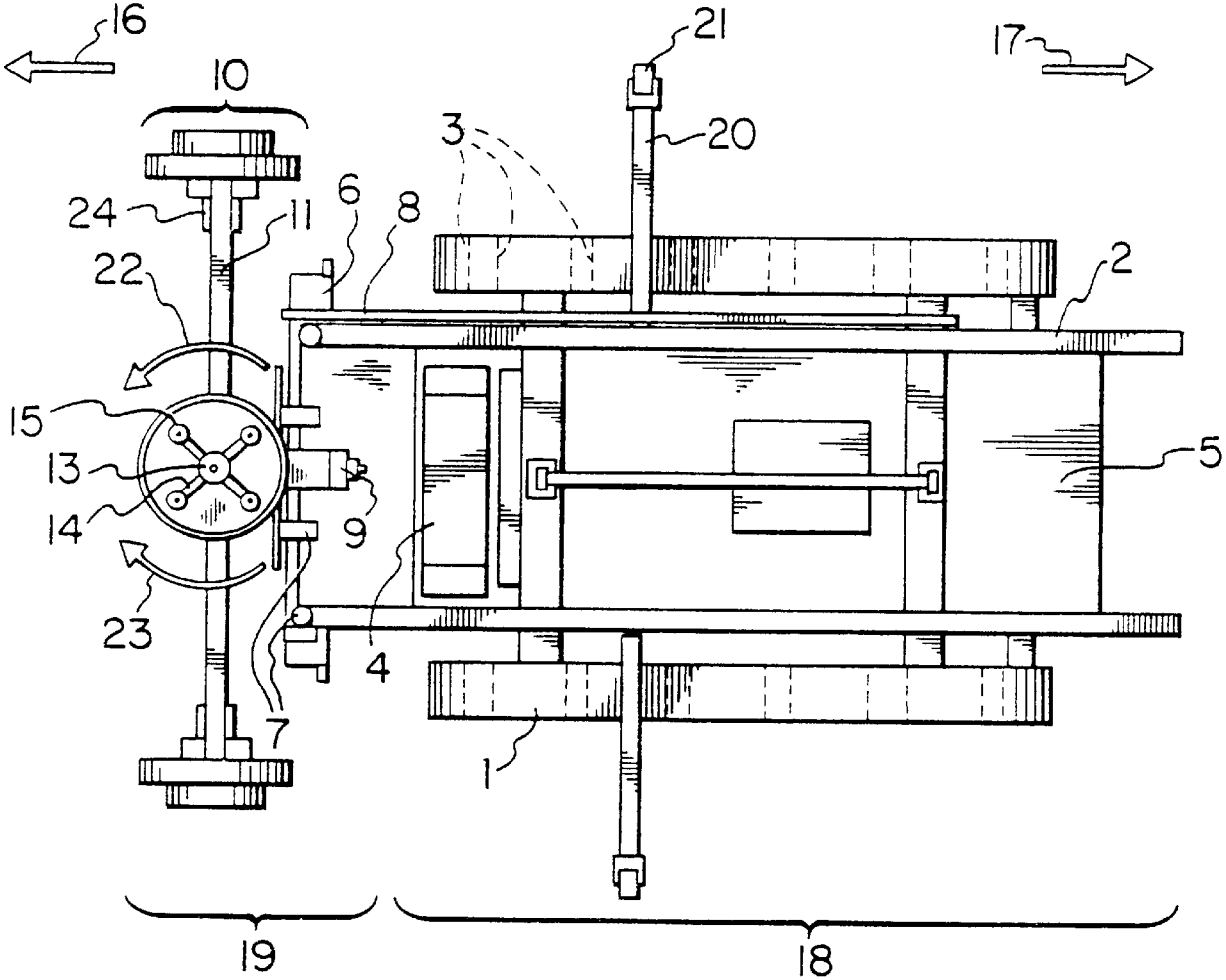
FIG. 13 is a top view of the second variant.

Referring to FIGS. 11 to 13, the vehicle 18, chassis 2, motor (not shown), guiding bars 20, guiding bar attachments 21, battery 4, hydraulic coupler, deadman and drawbar (not shown) are substantially the same as that of the scarifier in FIG. 1 and the first variant. The principal arm 7 is oriented vertically and is essentially the same as the arm in the first variant, but has a plurality of additional subsidiary arms 11 which extend transversely from the center of the principal arm 7. The adjusters 6 move vertically to align the center of the subsidiary arms 11 with the center of the pipe. The subsidiary arms 11 are telescopically adjustable so that they can extend transversely to the inner surface of the pipeline walls. A fluid coupler 9 with flow control valve receives fluid under pressure from an external source (not shown). An exchanger/actuator 33 simultaneously rotates or oscillates the subsidiary arms 11 and distributes the fluid. At the end of each subsidiary arm 11 is a nozzle assembly 10 that is basically the same as that of the scarifier of FIGS. 1–4. Each nozzle assembly 10 has a secondary fluid coupler 24, an exchanger/actuator 13, symmetrical branches 14, and nozzles 15. The vehicle 18 travels longitudinally along the center of the pipe in a direction indicated by arrows 16 or 17, while the subsidiary arms 11 rotate or oscillate in the direction of arrow 22 or 23, moving the nozzle assemblies 10 laterally across the inner circumference of the pipeline wall. The nozzle assemblies 10 are simultaneously rotating or oscillating such that they are cleaning a swath similar to the scarifier of FIGS. 1–4, but the swath is laterally oriented.

The second variant is most useful for cleaning the entire circumference of the interior of a cylindrical pipe. However, the wide swath enabled by incorporating the nozzle assembly 10 from the first embodiment permits the vehicle 18 to travel faster down the pipeline floor and still maintain adequate coverage of the walls.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. An apparatus for scarifying an interior surface of a sewer pipe both of round and non-round cross-section, said apparatus having a nozzle for discharging fluid under pressure against the interior surface, comprising:

(a) a vehicle moveable along an interior of said pipe in a direction substantially parallel to an axis of said pipe;

(b) a principal arm coupled to said vehicle; and (c) a scarifying assembly rotatably coupled to said principal arm having a fluid nozzle assembly with at least one fluid nozzle, said fluid nozzle assembly operative to one of rotate and oscillate, one of said scarifying assembly and said principal arm being extendible to place said fluid nozzle at a location adjacent to the interior surface of said pipe and operative, as said vehicle moves along the interior of said pipe, to remove contaminants and corrosion products from a selected region along the interior surface of said pipe, the selected region being of an area larger than an area that would be scarified by said nozzle if it were not rotating or oscillating, when fluid from said fluid nozzle assembly is directed as a jet against the interior surface of said pipe.

2. The apparatus according to claim 1, wherein said scarifying assembly has an exchanger couplable to a source of pressurized fluid, and a plurality of nozzle branches coupled to said exchanger and a plurality of nozzles affixed to a distal end of each of said nozzle branches, said exchanger, nozzle branches and nozzles operative to rotate relative to said vehicle and said exchanger operative to direct pressurized fluid into each of said nozzle branches and out of each of said nozzles as a jet stream of fluid capable of scarifying on impact the interior surface of said pipe.

3. The apparatus according to claim 2, wherein one of said principal arm and said nozzle assembly is extendible to locate said nozzles adjacent to a bottom surface of said pipe and said pressurized fluid expelled from said nozzles impacts the bottom surface of said pipe.

4. The apparatus according to claim 2, wherein said exchanger is further operative to use energy from said pressurized fluid to move said cleaning assembly with respect to said vehicle.

5. The apparatus according to claim 1, wherein said fluid nozzle assembly includes:

a) a plurality of branches mounted to a distal end of said arm, rotatable about an axis parallel to an axis of said principal arm; and b) a plurality of fluid nozzles, each attaching to a corresponding one of said branches, each of said fluid nozzles operative to expel said pressurized fluid against the interior surface of said pipe;

wherein said principal arm is adjustable to position said fluid nozzles at a desired position adjacent to the interior surface of the pipe.

6. The apparatus according to claim 5, wherein said nozzle assembly cleans a linear swath over the interior surface of said pipe along the direction of travel of said vehicle.

7. The apparatus according to claim 1, wherein said vehicle comprises:

(a) a chassis operative to support said scarifying assembly, said chassis having a pair of spaced apart tracks positioned on either side of said chassis, said tracks operative upon rotation to propel said vehicle along a longitudinal direction in the interior of said pipe, said-spaced apart tracks being laterally adjustable to pass through pipes and openings of various sizes;

b) a motor mounted on said chassis and coupled to said spaced apart tracks, said motor operative to rotate said tracks; and c) a power coupler mounted on said chassis and couplable to a power source, said power coupler operative to conduct power to said apparatus.

8. The apparatus according to claim 7, which further comprises an appliance which is one of mechanical, electromechanical and electric, said appliance being operative to enable selection of a speed and a direction of motion of said vehicle by controlling said power coupler and said motor in response to user input, which user input is applied to said appliance from one of a direct source and a remote source.

9. The apparatus according to claim 7, wherein said power coupler is operative to provide power to an actuator, said actuator operative to move said scarifying assembly with respect to said vehicle.

10. The apparatus according to claim 9, which further comprises an appliance which is one of mechanical, electromechanical and electric, said appliance being operative to enable selection of a speed and a direction of said scarifying assembly as said scarifying assembly is being moved with respect to said vehicle by controlling said actuator in response to user input, which user input is applied to said appliance from one of a direct source and a remote source.

11. The apparatus according to claim 10, wherein said actuator is operative to move said scarifying assembly in one of an oscillatory manner, a fully rotational manner and a combination of oscillatory and fully rotational manners.

12. The apparatus according to claim 1, wherein said scarifying assembly is operative to remove contaminants and corroded material from an interior surface of said pipe.

13. The apparatus according to claim 1, wherein said principal arm is telescoping and pivotally attached to said vehicle and pivotal through an angle proximate 0 degrees to the horizontal when said vehicle is on a level surface to an angle proximate 180 degrees and a nozzle assembly affixed to a distal end of said principal arm, said nozzle assembly being one of rotatable and oscillatory about a longitudinally extending axis of said principal arm.

14. The apparatus according to claim 1, wherein said scarifying assembly further comprises:

(a) a plurality of telescoping subsidiary arms rotatably mounted to said principle arm; and (b) a nozzle assembly mounted to a distal end of each of said subsidiary arms, each nozzle assembly being one of rotatable and oscillatory about an axis parallel to a longitudinally extending axis of said each subsidiary arm and operative to emit jets of pressurized fluid outwardly away from said distal end substantially parallel to said longitudinally extending axis.

15. The apparatus according to claim 1, wherein said vehicle is adapted for operation by a human operator.

16. The apparatus according to claim 1, wherein said scarifying assembly is operative to scarify a selected swath substantially larger than a swath that would be scarified by said nozzle if held in a fixed position relative to said vehicle adjacent the interior pipe surface.

17. The apparatus according to claim 1, wherein said arm is removable from said vehicle to allow said vehicle to pass through access openings to said pipe.

18. An apparatus according to claim 1, wherein said principal arm is an articulating arm.

* * * * *